US009987717B2

(12) United States Patent
Coelho

(10) Patent No.: US 9,987,717 B2
(45) Date of Patent: Jun. 5, 2018

(54) FINISHING DEVICE

(71) Applicant: Supfina Grieshaber GmbH & Co. KG, Wolfach (DE)

(72) Inventor: Stephen Coelho, Johnston, RI (US)

(73) Assignee: SUPFINA GRIESHABER GMBH & CO. KG, Wolfach (DE)

( * ) Notice: Subject to any disclaimer, the term of this patent is extended or adjusted under 35 U.S.C. 154(b) by 162 days.

(21) Appl. No.: 15/051,696

(22) Filed: Feb. 24, 2016

(65) Prior Publication Data

US 2017/0239776 A1 Aug. 24, 2017

(51) Int. Cl.

| | |
|---|---|
| ***B24B 33/08*** | (2006.01) |
| ***B24B 21/00*** | (2006.01) |
| ***B24B 21/02*** | (2006.01) |
| ***B24B 21/04*** | (2006.01) |
| ***B24B 33/04*** | (2006.01) |
| ***B24B 5/01*** | (2006.01) |
| ***B24B 5/04*** | (2006.01) |
| ***B24B 5/42*** | (2006.01) |

(52) U.S. Cl.

CPC ..... *B24B 33/08* (2013.01); *B24B 5/01* (2013.01); *B24B 5/047* (2013.01); *B24B 5/42* (2013.01); *B24B 21/004* (2013.01); *B24B 21/02* (2013.01); *B24B 21/04* (2013.01); *B24B 33/04* (2013.01)

(58) Field of Classification Search

CPC ..... B24B 21/004; B24B 21/02; B24B 21/04; B24B 33/04; B24B 33/08; B24B 5/01; B24B 5/047; B24B 5/42

See application file for complete search history.

(56) References Cited

U.S. PATENT DOCUMENTS 4,833,834 A * 5/1989 Patterson ..... B24B 19/12 451/239
5,142,827 A * 9/1992 Phillips ..... B24B 5/42 451/57
5,367,866 A * 11/1994 Phillips ..... B24B 5/42 451/14

(Continued)

FOREIGN PATENT DOCUMENTS

CN 2930968 Y 8/2007
DE 4423422 A1 1/1996

(Continued)

*Primary Examiner* — Marc Carlson
(74) *Attorney, Agent, or Firm* — Leydig, Voit & Mayer, Ltd.

(57) ABSTRACT

A finishing device includes a finishing belt, a finishing belt holding device, a first drive configured to rotationally drive a workpiece about a workpiece axis, and a second drive configured to oscillate the workpiece and the finishing belt relative to another along the workpiece axis. The finishing belt holding device has a holding section configured to hold a portion of the finishing belt. The portion has an active area configured to finish a circumferential workpiece surface. The portion extends in a plane which is vertical when referring to the direction of gravity and extends in a horizontal direction when referring to the direction of gravity and when viewing in the running direction of the finishing belt. The finishing device includes a workpiece holding device defining a workpiece holding axis which is vertical when referring to the direction of gravity.

17 Claims, 8 Drawing Sheets

(56) References Cited

U.S. PATENT DOCUMENTS

| | | | | |
|---|---|---|---|---|
| 5,437,125 | A * | 8/1995 | Barton, II | B24B 5/42 451/25 |
| 5,741,174 | A * | 4/1998 | Kaiser, Jr. | B24B 19/12 451/307 |
| 5,775,978 | A * | 7/1998 | Brocksieper | B24B 19/11 451/302 |
| 5,951,377 | A * | 9/1999 | Vaughn | B24B 5/42 451/14 |
| 7,794,306 | B2 * | 9/2010 | Kondo | B24B 5/42 451/49 |
| 9,114,497 | B2 * | 8/2015 | Hildebrandt | B24B 21/02 |
| 2004/0157530 | A1 * | 8/2004 | Omata | B24B 5/42 451/5 |
| 2006/0063420 | A1 | 3/2006 | Reibke et al. | |
| 2009/0142997 | A1 * | 6/2009 | Nagel | B24B 5/42 451/306 |
| 2010/0081346 | A1 | 4/2010 | Hoppe | |
| 2015/0013510 | A1 * | 1/2015 | Huber | B24B 19/12 82/1.11 |
| 2016/0045996 | A1 * | 2/2016 | Schmitz | B24B 27/0076 451/160 |

FOREIGN PATENT DOCUMENTS

| | | | |
|---|---|---|---|
| DE | 19526863 | A1 | 1/1997 |
| DE | 102004046471 | B3 | 2/2006 |
| DE | 102007024661 | A1 | 11/2007 |
| DE | 102006057712 | B3 | 4/2008 |
| DE | 102007024690 | A1 | 12/2008 |
| DE | 102007059926 | A1 | 6/2009 |
| DE | 102008025433 | A1 | 9/2009 |
| DE | 102008039219 | A1 | 2/2010 |
| DE | 202009016064 | U1 | 4/2011 |
| EP | 1447172 | A1 | 8/2004 |
| EP | 2617522 | A1 | 7/2013 |
| WO | WO 9805473 | A1 | 2/1998 |
| WO | WO 2015124204 | A1 | 8/2015 |

* cited by examiner

FINISHING DEVICE

TECHNICAL FIELD

The present invention relates to a finishing device, including a finishing belt, a finishing belt holding device, a first drive for rotationally driving a workpiece about a workpiece axis and a second drive for oscillating the workpiece and the finishing belt relative to another along the workpiece axis.

BACKGROUND OF THE INVENTION

Finishing devices are also known as "shortstroke honing devices" and are described, e.g., in DE 10 2007 059 926 A1 (corresponding to US 2009/0142997 A1) and 44 23 422 A1.

Such devices are used for the finish machining of circumferential surfaces of substantially rotationally symmetrical workpiece portions on workpieces, such as crankshafts or camshafts. Finishing is a precision machining method, in which the circumferential surfaces of substantially rotationally symmetrical workpiece portions on workpieces (such as main journals and pin journals of a crankshaft) are worked for producing a particularly smooth surface structure. Finishing involves a machining tool having a granular cutting compound of a finishing stone or belt being pressed by a pressing device onto the circumferential surface to be worked. To produce the cutting speed necessary for material removal, in many method variants the workpiece is rotated about its workpiece axis and simultaneously an oscillating relative movement parallel to the workpiece axis is produced between the workpiece and the machining tool engaging on the circumferential surface. As a result of the combination of the rotary movement of the workpiece and the superimposed oscillatory movement a so-called crosscut pattern can be produced, so that the worked workpiece circumferential surfaces are particularly suitable e.g. as contact surfaces for roller or plain bearings, etc.

The workpieces can e.g. be camshafts or crankshafts. Such workpieces are provided in axially spaced manner with mutually rotationally symmetrical workpiece portions serving as bearing points. The so-called main bearings or journals are positioned coaxially to the workpiece axis and serve to mount the shaft for its rotary movement within the engine housing. Immediately alongside a main journal are provided one or two so-called pin, stroke or lift journals, whose axes are parallel and displaced eccentrically to the workpiece axis. Other parts of a machine, e.g. the connecting rods of pistons of an internal combustion engine or a pump or a compressor engage on the pin journals.

During the finish machining of such workpieces, use is generally made of devices making it possible to simultaneously work or machine several of the workpiece portions of the same workpiece. Such finishing devices have a number of finishing units, each of the finishing units having at least one finishing tool and wherein each of the workpiece portions to be machined is associated to one of the finishing units.

When used for large-scale production, for example when finishing the crankshaft of a four-cylinder engine commonly used in a great number of vehicles, setting up a finishing device may consume a considerable amount of time and effort which then is compensated for by an extended operation time of the device. Such a compensation is difficult or impossible to achieve when using the finishing method for medium and small batch production, thus making this method comparatively expensive.

The present invention discloses a finishing device which is particularly well suited for a medium or small batch production.

BRIEF SUMMARY OF THE INVENTION

The present invention provides a finishing device including a finishing belt, a finishing belt holding device, a first drive configured to rotationally drive a workpiece about a workpiece axis, and a second drive configured to oscillate the workpiece and the finishing belt relative to another along the workpiece axis. The finishing belt holding device has a holding section configured to hold a portion of the finishing belt. The portion has an active area configured to finish a circumferential workpiece surface. The portion extends in a plane which is vertical when referring to the direction of gravity and extends in a horizontal direction when referring to the direction of gravity and when viewing in the running direction of the finishing belt. The finishing device includes a workpiece holding device defining a workpiece holding axis which is vertical when referring to the direction of gravity.

The finishing device in accordance with the invention provides for a vertical machine concept including a workpiece holding axis which is vertical when referring to the direction of gravity. The active area of a finishing belt extends in a plane which is vertical when referring to the direction of gravity, wherein this portion extends in a horizontal direction when referring to the direction of gravity and when viewing in the running direction of the belt.

The finishing device according to the invention provides for a concept which is tilted by an angle of 90° with respect to conventional finishing devices known from prior art. The new concept provides for a very small footprint of the finishing device which thus occupies a small shop floor area only. Further, the vertical machine concept has the advantage that parts of the finishing device are easily accessible such that the finishing device according to the invention can be set up in a fast and easy manner such that preparing the finishing device for finishing workpieces of a medium or small batch will take less time compared to conventional horizontal machine concepts.

In accordance with one embodiment of the invention, the finishing belt holding device includes a supply of finishing belt which includes a supply roll which is rotatable about a supply roll axis which is vertical when referring to the direction of gravity. The advantage of such a supply roll and the vertical orientation of the supply roll axis is that the finishing belt is not twisted and always extends in vertical planes only.

According to a further embodiment, the finishing belt holding device includes a driving unit for driving the finishing belt in a driving direction which is horizontal when referring to the direction of gravity. Again, by using such a driving unit, the finishing belt is not twisted and always extends in vertical planes only.

According to a yet another embodiment of the invention, the finishing belt holding device includes a holding plate extending in a holding plate plane which is horizontal when referring to the direction of gravity. Such a holding plate provides for easy and economic positioning of all parts interacting with a finishing belt, for example such as an aforementioned supply roll and/or a driving unit.

In yet another embodiment the holding plate is pivotable between a working position and a maintenance position in a horizontal direction about a pivot axis which is vertical when referring to the direction of gravity. By pivoting the holding plate, the finishing belt and all part interacting with the finishing belt can be positioned in a working position (in which the finishing belt is in contact with or positioned near the surface of the workpiece to be finished) and a maintenance position (in which the finishing belt and/or parts interacting with the finishing belt can be maintained or replaced). Due to the vertical machine concept of the present invention, the holding plate, the associated finishing belt and all other associated parts remain at the same vertical level, independent of the holding plate being in the working position or being in the maintenance position. The advantage of this is a very ergonomic design which helps an operator to set up and prepare the finishing device for a new batch of workpieces in a fast and convenient manner.

Is a further embodiment wherein a guiding device is provided which—in the working position of the holding plate—compensates for a vertical misalignment and/or deflection of the holding plate. This means that the position and orientation of the holding plate is not only defined by the pivot axis but also by a separate guiding device such that an exact position of the active area of the finishing belt which is associated to the holding plate can be defined.

Even though it is possible that a finishing device according to the invention includes one finishing belt and one finishing belt holding device only, multiple finishing belt holding devices can be provided, in particular a first subset of finishing belt holding devices being offset from a second subset of finishing belt holding devices when referring to the circumference of the workpiece. This means that—when viewing the finishing device from the top—at least two different finishing belt holding devices (each of which include a finishing belt) are provided from different angular directions, each of these finishing belt holding devices holding/carrying finishing belts separate from one another and these finishing belts contacting the workpiece with different active areas and from different angles.

Contacting the workpiece with different active areas of different finishing belts has the advantage that the overall machining time can be reduced. Further, working a workpiece from different angles will eliminate workpiece deflection, in particular when the offset between a first subset and a second subset of finishing belt holding devices is an angle of approximately or exact 180°.

It is a further embodiment wherein the finishing belt holding devices of a first subset are offset from the finishing belt holding devices of a second subset when referring to the workpiece axis. This allows for a synchronous machining of separate journal surfaces of the same workpiece. For example, a first subset of finishing belts associated to their finishing belt holding devices may be used for finishing main journal surfaces of a crankshaft, whereas finishing belts of a second subset of finishing belt holding devices may be used for synchronously machining pin bearing surfaces of the crankshaft. This arrangement is particularly advantageous when main bearing surfaces and pin bearing surfaces are positioned in an alternate manner when viewing along the main axis of the crankshaft.

To further improve finishing devices and make them more eligible for small and medium batch production at least one finishing belt handling device can be provided for finishing at least one workpiece surface extending in a workpiece plane which is perpendicular to the workpiece axis. This allows for the subsequent or even synchronous machining of thrust faces commonly used for crankshafts in order to define an axial position of the crankshaft within the engine housing.

When such a finishing belt handling device is provided it is offset from the at least one finishing belt holding device when referring to the circumference of the workpiece. This allows for synchronously accessing the workpiece by means of the active area of the finishing belt which finishes a circumferential surface and by means of the finishing belt of the finishing belt handling device which finishes a workpiece surface extending perpendicularly to the circumferential surface.

Preferred angles of offset between at least one finishing belt handling device and the finishing belt holding device are about 90° or about 180°.

The accessibility of the finishing belt handling device is enhanced when at least one finishing belt handling device is movable between a working position and a maintenance position along an axis which is horizontal when referring to the direction of gravity. In one embodiment a drive is provided for driving at least one finishing belt handling device along the axis.

It is possible that the workpiece remains in a fixed position with respect to the vertical direction and that the finishing belt holding devices oscillate in a vertical direction (by means of the second drive and/or additional drives). In this case, the finishing belt handling device may also remain in a fixed position with respect to the vertical direction.

It is also possible that the workpiece oscillates in a vertical direction (by means of the second drive and/or additional drives). In this case it is preferred that at least a working area of the at least one finishing belt handling device is movable along an axis which is vertical when referring to the direction of gravity, in order to allow for a synchronous machining of circumferential surfaces and plane surfaces extending perpendicularly to such circumferential surfaces. This means that the finishing belt handling device or at least a working area thereof may follow the oscillating movement of the workpiece to which the workpiece is imposed to during finishing machining of circumferential surfaces.

It is possible that the finishing belt handling device or at least its working area is simply guided along a vertical axis and is then driven by means of the workpiece which interacts (e.g. in a form engaging manner) with the finishing belt handling device. However, it may be preferred that the finishing belt handling device is supported by a weight supporting device which compensates for the weight of the finishing belt handling device. Such a weight supporting device may thus reduce lateral forces acting on the workpiece.

To further reduce forces acting on the workpiece it may be preferred that a mass compensation device is provided for compensating for the mass inertia of the finishing belt handling device. Such a mass compensation device may include actuators which are arranged at opposite vertical ends of the finishing belt handling device, wherein an upper actuator is loaded due to the upward movement of the finishing belt handling device and unloaded in a downward moving direction of the finishing belt handling device. Accordingly, a lower actuator is loaded in a downward moving direction of the finishing belt handling device and unloaded in an upward moving direction of the finishing belt handling device. Such actuators may include mechanical springs and/or pneumatic actuators.

Similarly, in a further embodiment a mass compensation device may be provided for compensating for the mass inertia of at least one of the first drive or of the second drive or of the workpiece holding device or of the workpiece.

Further examples and embodiments of above mentioned mass compensation devices, their design and operation are disclosed in EP 2 617 522 A1 of the applicant, the content of which is hereby incorporated by reference in its entirety.

In the case that the workpiece oscillates in a vertical direction, it is possible that the finishing belt handling device or at least a working area thereof is also oscillating in a vertical direction by means of either being coupled to the second drive (or to parts which are driven by the second drive) or by being coupled to a separate drive.

Finally, it is contemplated that a machine housing is provided, the machine housing including housing parts which are moveable between a working position and a maintenance position, wherein a drive for moving the housing parts is provided. Such a machine housing protects the environment and operators from parts of a finishing device which are moving during operation, keeps cooling liquid within the machine housing but at the same time enables an operator to easily access parts of the finishing device in order to maintain them or in order to set them up for a different batch of workpieces.

The features of the invention are apparent from the claims, description and drawings and the individual features, both singly or in the form of subcombinations, can be implemented in an embodiment of the invention and can represent advantageous, independently protectable constructions.

BRIEF DESCRIPTION OF THE SEVERAL VIEWS OF THE DRAWING(S)

Embodiments of the invention are described hereinafter relative to the drawings, wherein.

Figure 1:
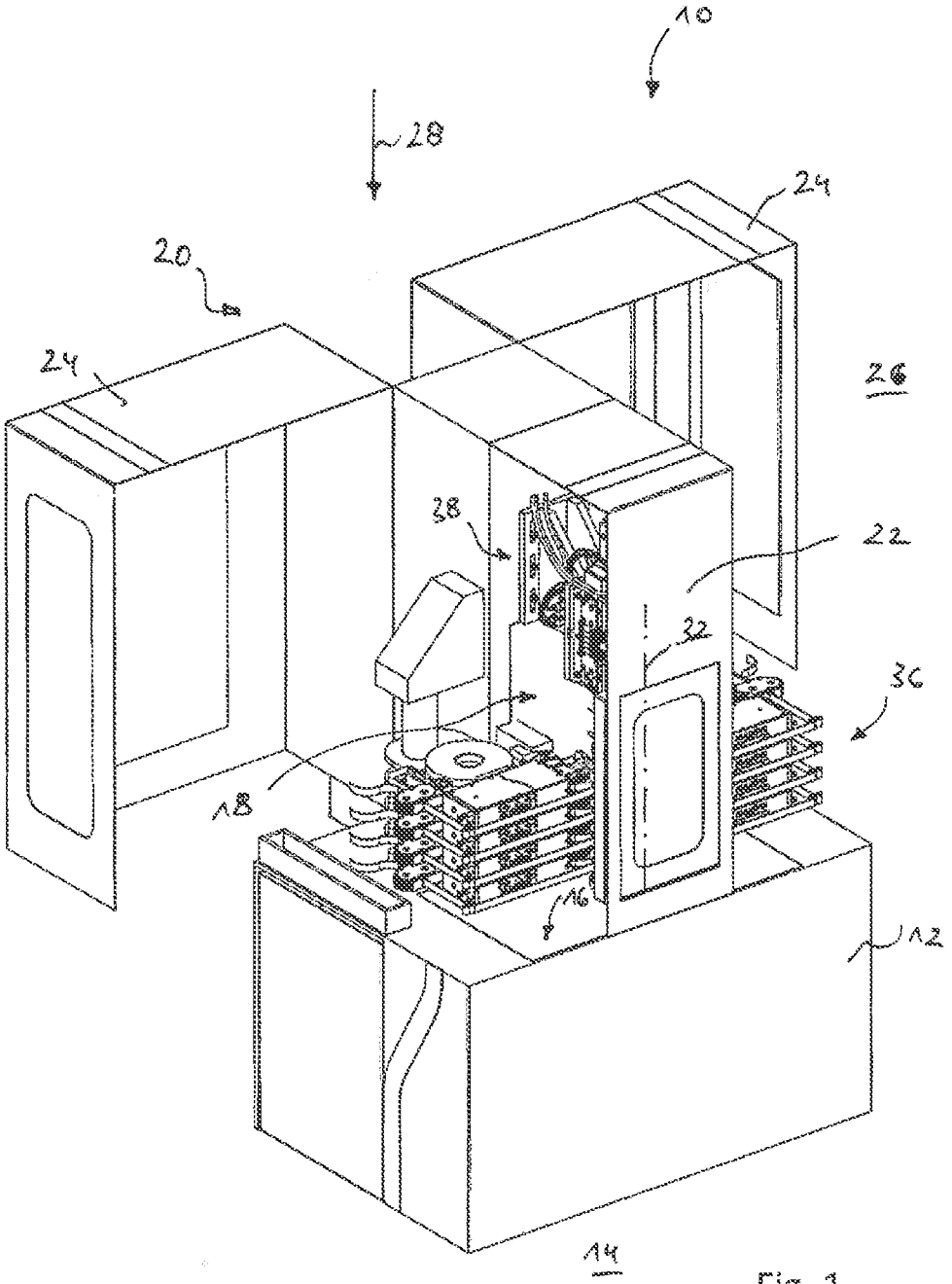
FIG. 1 is a perspective view of an embodiment of a finishing device having a machine housing and interior parts.
Figure 5A:
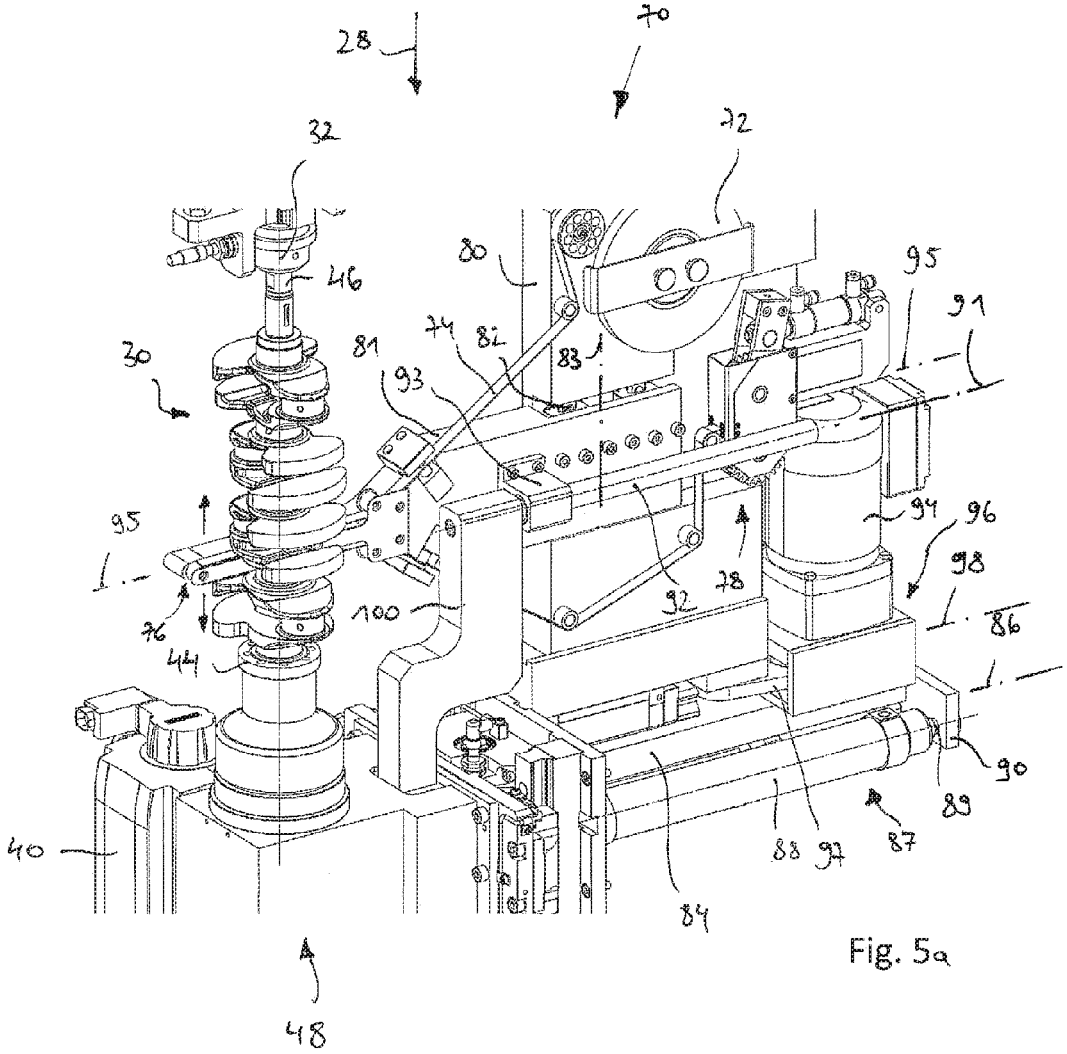
Figure 5B:
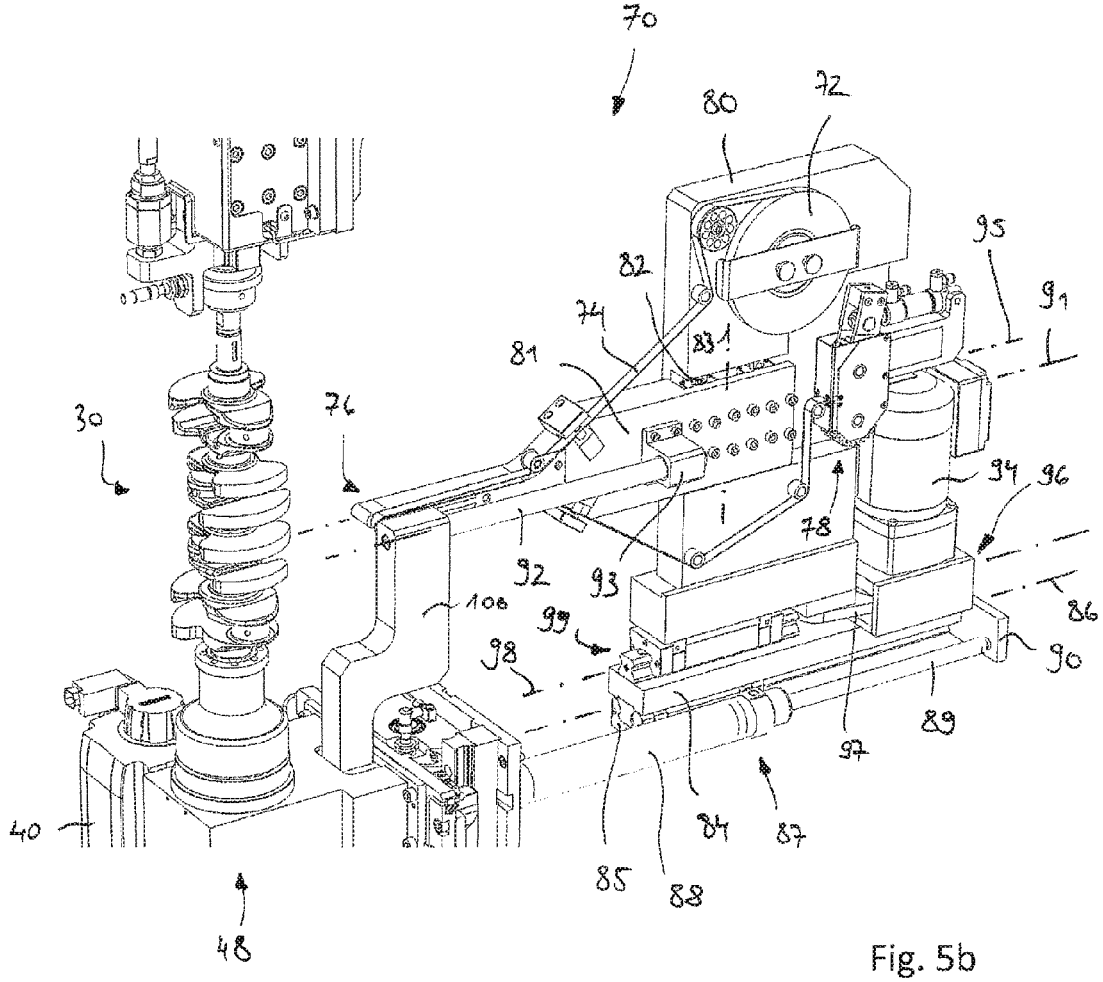
Figure 6:
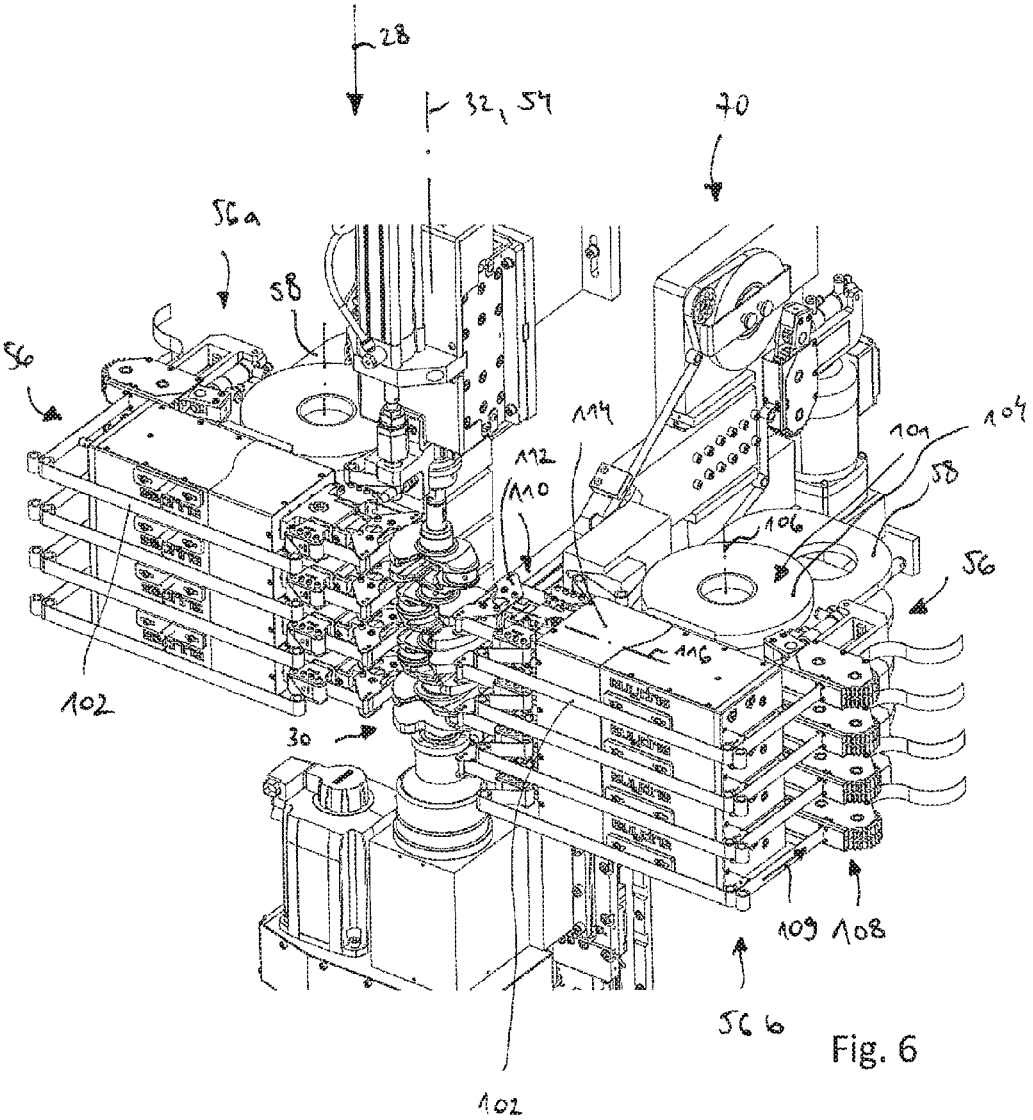
Figure 7:
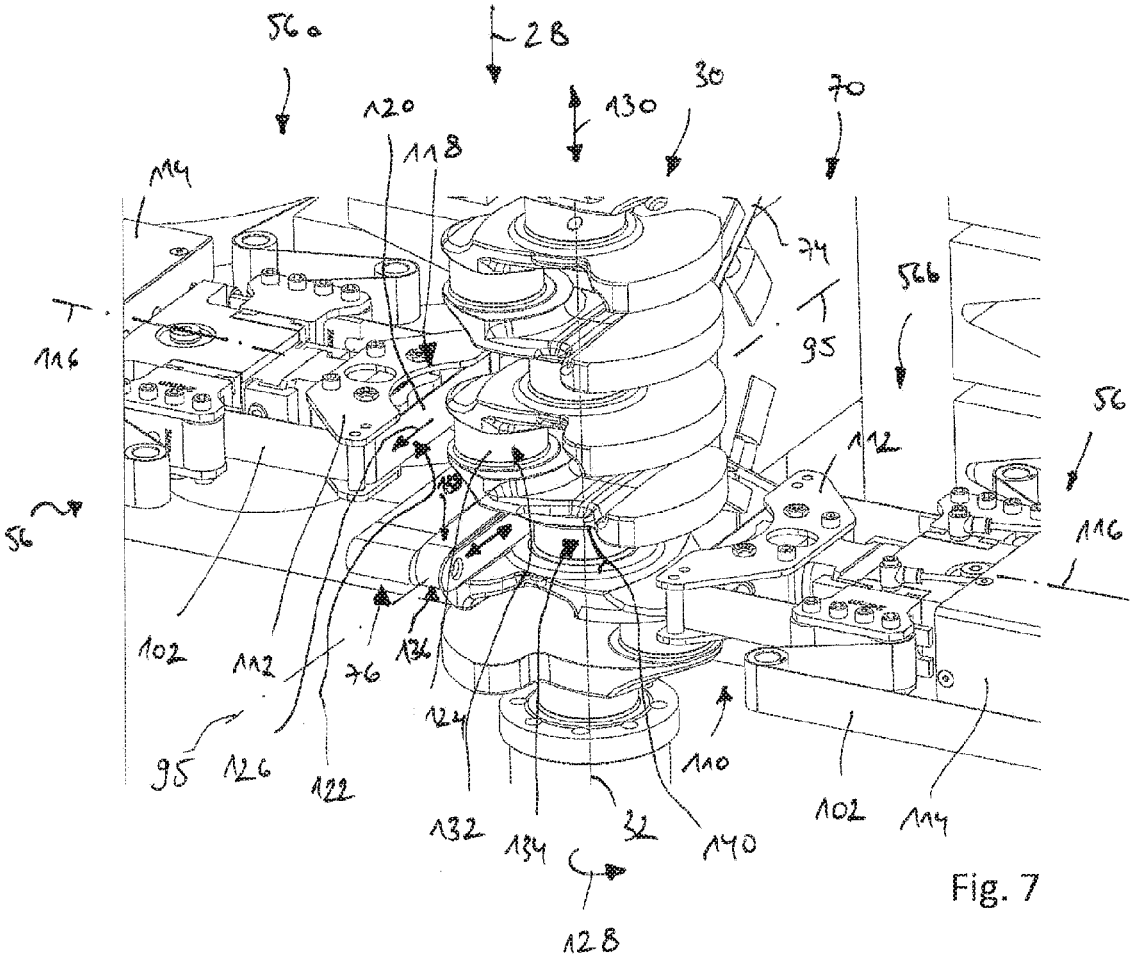

FIG. 5*a* is a perspective view of a finishing belt handling device of the device of FIG. 1, the finishing belt handling device being designed for the machining thrust faces of a workpiece, the finishing belt handling device being shown in its working position;

FIG. 5*b* is a perspective view corresponding to FIG. 5*a*, the finishing belt handling device being shown in its maintenance and loading position;

FIG. 6 is a perspective view of the two subsets of finishing belt holding devices and the finishing belt handling device; and FIG. 7 is a perspective view of a large scale detail of FIG. 6.

DETAILED DESCRIPTION OF THE INVENTION

In the drawings, reference sign 10 designates a machine tool in the form of a finishing device. The device 10 includes a machine frame 12 which is set up on a floor 14 and has a horizontal upper surface 16 delimiting the lower end of a workspace 18.

The workspace 18 is further limited towards the sides and towards the top by means of a machine housing 20. The housing 20 may include stationary housing elements 22 and movable housing parts 24. The movable housing parts 24 may be positioned in a maintenance position (FIG. 1) allowing for an easy access to the workspace 18. The movable housing parts 24 may also be positioned in a working position, in which the housing parts delimit a box-shaped workspace 18 and provide protection for an environment 26 of the device 10. For moving the housing parts 24, they may be mounted in a pivotable manner and handled manually or driven by means of a drive which may for example be electric.

When using the expressions "horizontal" and "vertical" in the context of the present invention, these expressions relate to the direction of gravity which is indicated in the drawing by means of an arrow 28. Thus, "vertical" means an orientation which is parallel to the direction of gravity 28 and "horizontal" means an orientation which is perpendicular to the direction of gravity 28. In a typical production environment, the floor 14 for setting up the device 10 will be horizontal such that the floor extends in a perpendicular direction with respect to the direction of gravity 28.

Figure 2:
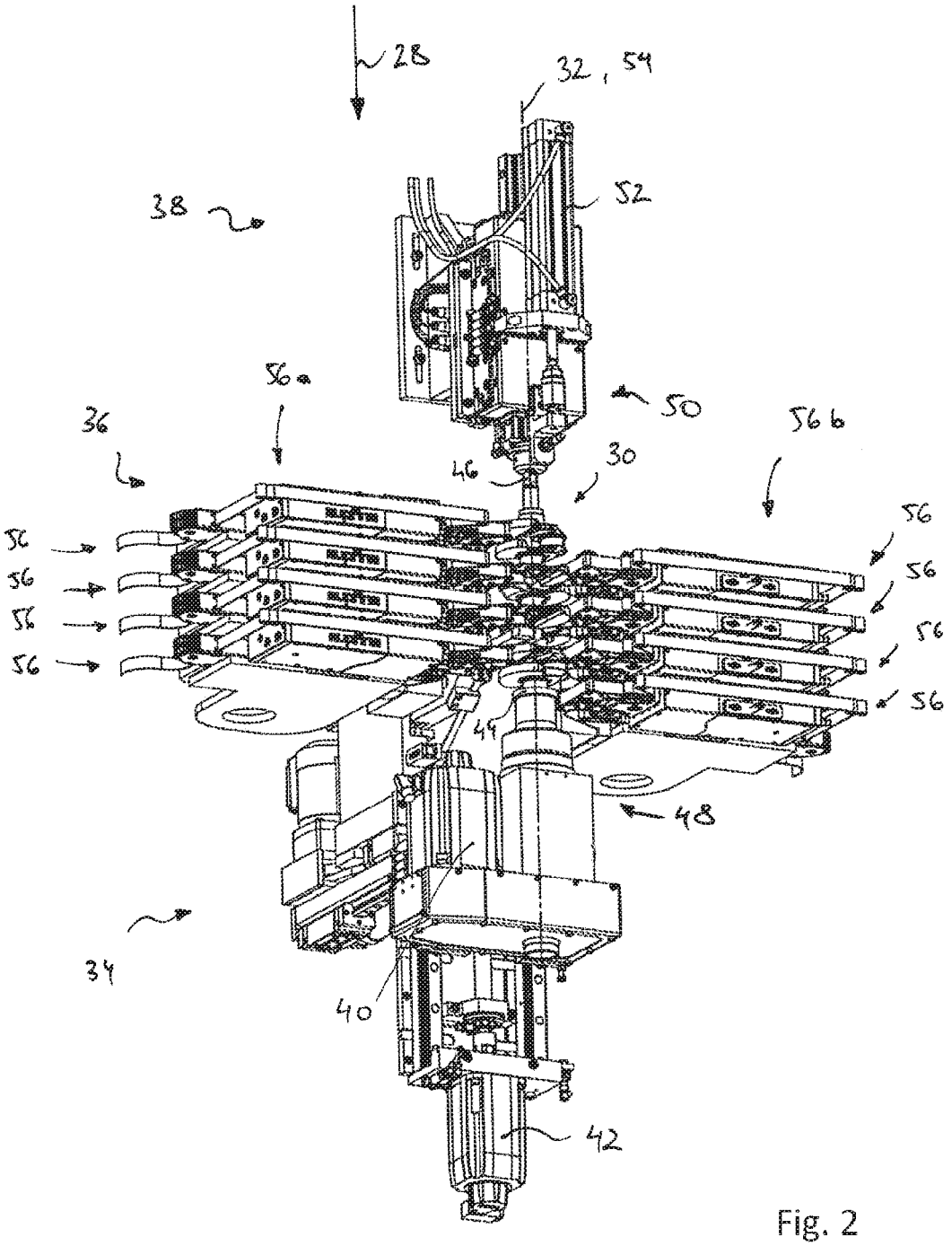
FIG. 2 is a perspective view of some of the interior parts of the finishing device of FIG. 1, including finishing belt holding devices.

The workspace 18 accommodates a workpiece 30 (FIG. 2) which is to be finished. The workpiece 30 extends along a vertical workpiece axis 32 (FIGS. 1 and 2). During a finishing operation of the device 10, the workpiece 30 rotates around the axis 32 in a continuous manner and—at the same time—moves in an oscillating manner back and forth along the axis 32.

The device 10 includes parts shown in FIG. 2. When referring to the direction of the vertical axis 32, first parts 34 are arranged at a lower end and within machine frame 12. Middle parts 36 and upper parts 38 are arranged above the upper surface 16 and within the workspace 18 (FIG. 1).

First parts 34 include a first drive 40 for rotationally driving the workpiece 30 about the workpiece axis 32. First parts 34 also include a second drive 42 for oscillating the workpiece 30 back and forth along the workpiece axis 32.

The first drive 40 includes a workpiece holding element 44 which interacts with a lower end of the workpiece 30. At an upper end of the workpiece 30, the workpiece 30 is held by means of another workpiece holding element 46. In a particularly preferred embodiment, workpiece holding element 44 is part of head stock 48, and workpiece holding element 46 is part of a tail stock 50. Workpiece holding elements 44 and 46 together constitute a workpiece holding device 44, 46.

Head stock 48 and tail stock 50 may be mounted to a common carrier which oscillates back and forth by means of the second drive 42. It is also possible that the second drive 42 only acts on head stock 48 (and the associated drive 40) and that tail stock 50 follows the oscillating movement of head stock 48 and workpiece 30 by means of a pneumatic actor 52. Independent of the head stock 48 and the tail stock 50 being mounted on a common or on separate carriers, the workpiece holding device 44, 46 defines a workpiece holding axis 54 which is identical with the workpiece axis 32 when the workpiece 30 is mounted and held by means of the workpiece holding device 44, 46.

Middle parts 36 include a plurality of finishing belt holding devices 56. These holding devices 56 are arranged such that they include a first subset 56*a* of at least one finishing belt holding device 56, for example four or six finishing belt holding devices, and a second subset 56*b* also comprising at least one finishing belt holding device 56, for example four or six finishing belt holding devices 56. The subsets 56*a* and 56*b* are offset from one another when referring to the circumference of the workpiece 30. In the working position of the finishing belt holding devices 56, the angular offset between the first subset 56*a* and the second subset 56*b* is 180°, (FIG. 2).

Each finishing belt holding device 56 includes a holding plate 58 for holding parts explained in greater detail hereinafter. The holding plates 58 of each subset 56*a*, 56*b* are pivotably mounted about stationary pivot axes 60*a*, 60*b*, these axes each being defined by means of a column 62*a*, 62*b*.

The finishing belt holding devices 56 of a particular subset 56*a* or 56*b* are pivotable about the associated pivot axis 60*a* or 60*b*, either independently of one another or being connected to one another and thus being pivotable as a unit of a plurality of finishing belt holding devices 56.

Figure 3:
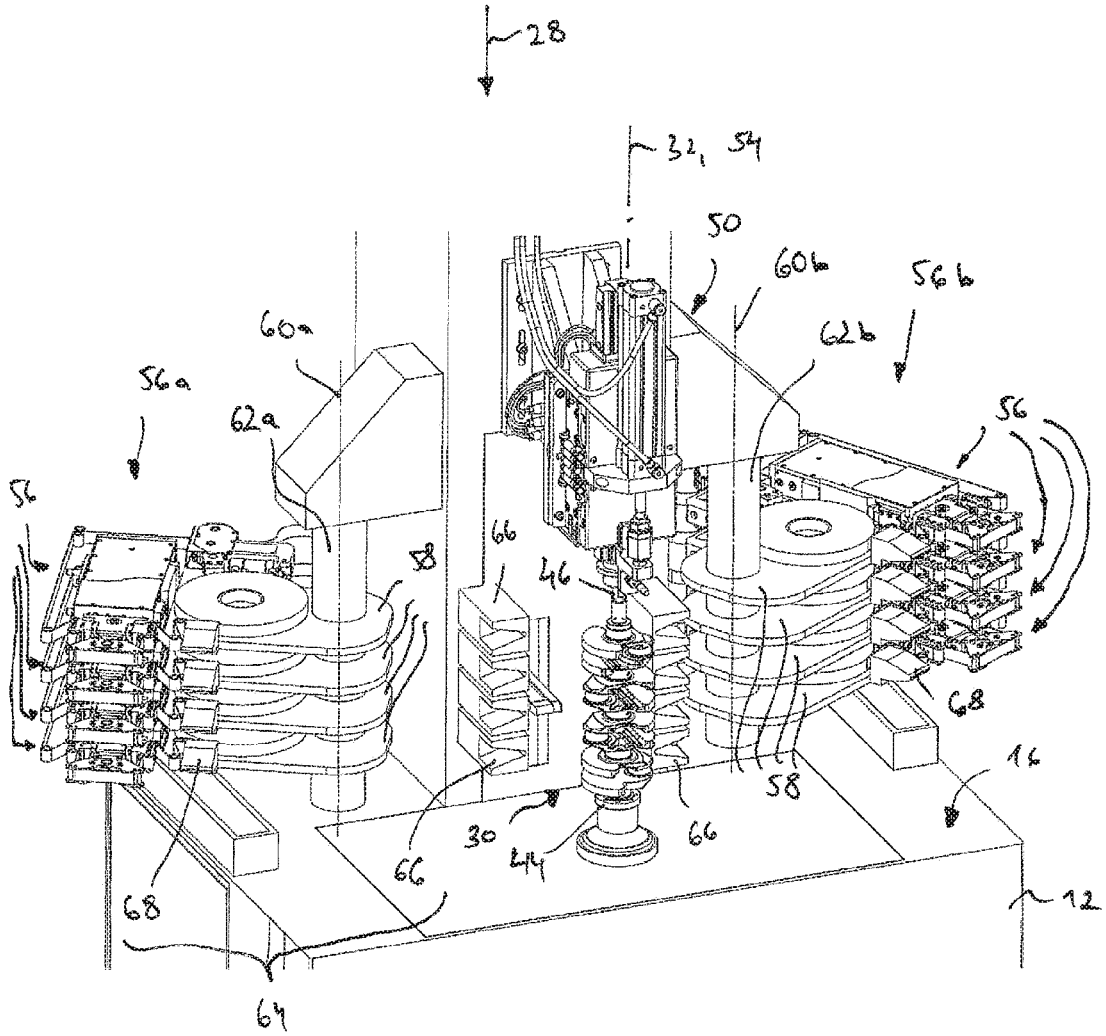
FIG. 3 is a perspective view of two subsets of finishing belt holding devices, the subsets being positioned in a maintenance position.
Figure 4:
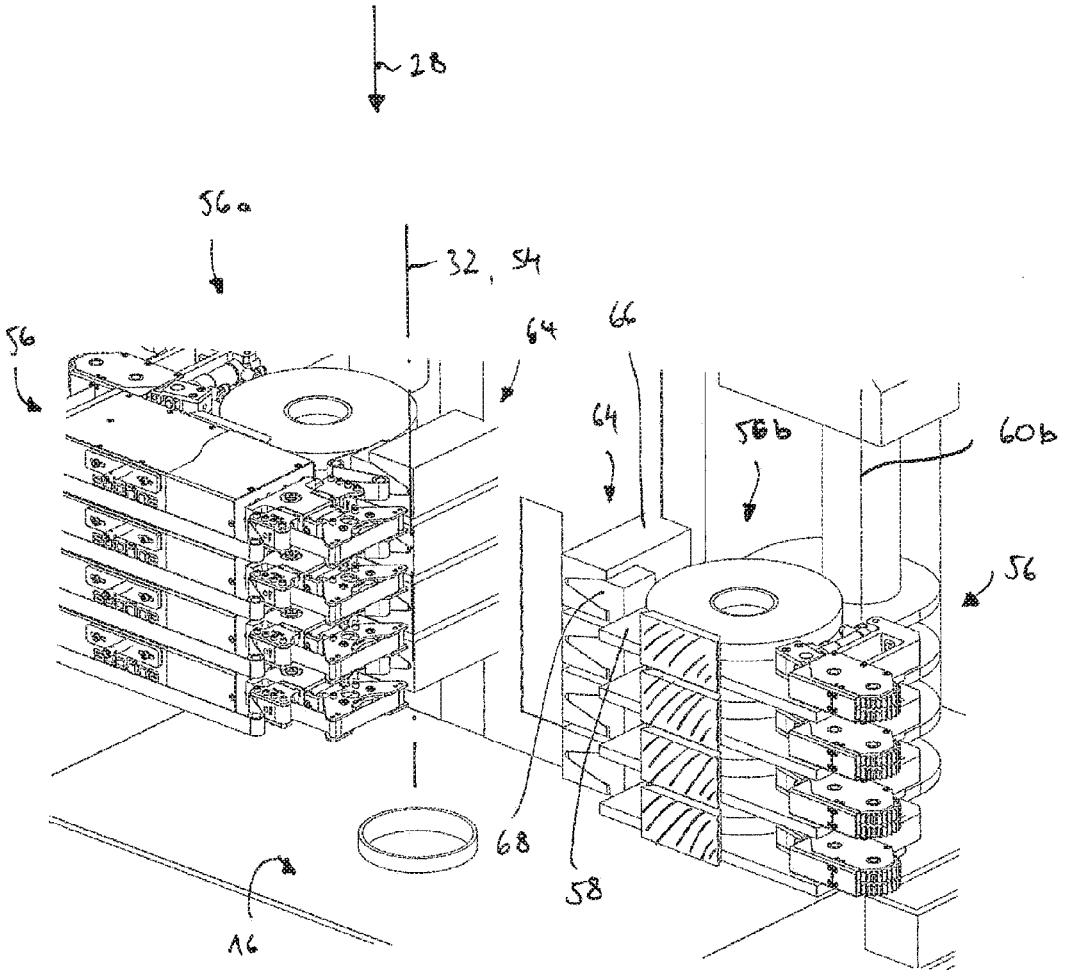
FIG. 4 is a perspective view of the subsets of FIG. 3, the subsets being positioned in a working position.

By pivoting one or a plurality of finishing belt holding devices 56 about an associated pivot axis 60*a*, 60*b*, a finishing belt holding device 56 is movable between a maintenance position (FIG. 3) and a working position (FIGS. 2 and 4).

In FIG. 4, portions of the finishing belt holding devices 56 of the second subset 56*b* are not shown to better illustrate the design and functionality of a guiding device 64. It is preferred that the finishing device 10 includes one guiding device for each finishing belt holding device 56. Each guiding device 64 includes a receptacle 66 which interacts with a protrusion 68. One of the elements 66 and 68 is mounted in a stationary manner, for example a receptacle 66. The other element, for example the protrusion 68, is mounted in a movable manner and is stationary with respect to the holding plate 58 of a particular finishing belt holding device 56. In the maintenance position of a finishing belt holding device 56, the protrusion 68 and the receptacle 66 are separate from one another (FIG. 3). In the working position of a finishing belt holding device 56, the protrusion 68 interacts with the receptacle 66 in a form engaging manner such that a vertical position of the holding plate 58 is defined by means of the guiding device 64.

The protrusion 68 may have the shape of a wedge; the receptacle 66 may have a corresponding v-shaped notch.

The finishing device 10 may optionally include a finishing belt handling device 70 which is shown in greater detail in FIGS. 5*a* and 5*b*. The finishing belt handling device 70 includes a supply 72 for a finishing belt 74 which is guided such that in a working area 76 the abrasive, active side of the finishing belt 74 is orientated in two parallel planes which are perpendicular to the workpiece axis 32, such that corresponding workpiece surfaces such as thrust faces can be machined by means of finishing belt 74.

The finishing belt handling device 70 also includes a drive 78 for driving (pulling) finishing belt 74. The supply 72 and the drive 78 are mounted to a frame 80.

The working area 76 of the finishing belt 74 is defined by a front tip of a slide 81. The slide 81 is guided by means of a linear bearing 82 and thus movable along a vertical axis 83 with respect to the frame 80.

The weight of the frame 80 and the parts connected with it is supported by a base 84 which is supported and guided by a linear guiding 85. The linear guiding 85 is fixed with respect to the machine frame 12 and defines a horizontal axis 86 along which frame 80 is movable between a working position (FIG. 5*a*) and a retracted maintenance and unloading position (FIG. 5*b*) by means of a drive 87.

The drive 87 which may for example be a pneumatic cylinder 88 having a piston 89 which is connected to a connecting part 90 which is coupled to the base 84.

The slide 81 is guided along an axis 91 which is parallel to the horizontal axis 86 and which is defined by a stationary column 92. The slide 81 includes a bushing 93 which slidably engages column 92.

The finishing belt handling device 70 also includes a drive 94 for oscillating frame 80 and in particular slide 81 and its working area 76 in a horizontal direction along an oscillation axis 95. The drive 94 is fixed to base 84 and acts on an excenter unit 96 having a rod 97 which is connected to the frame 80. The frame 80 is movable along a horizontal axis 98 by means of a linear guiding 99 (FIG. 5*b*) which is effective between the base 84 and the frame 80.

The column 92 is connected to the head stock 48 by means of a connector 100. Due to this connection, a vertical oscillating movement of the head stock 48 (for example by means of second drive 42) is transferred the head stock 48 to column 92 and to the bushing 93 and to the slide 81 and to the working area 76, thereby driving the working area 76 in a vertical oscillating manner, as indicated with a double arrow (FIG. 5*a*). Because of the vertical linear bearing 82 effective between the slide 81 and the frame 80, the working area 76 can be driven in an oscillating manner along the horizontal axis 95 at the same time and independent of the vertical oscillating movement of the slide 81 and the associated working area 76.

When making use of the optional finishing belt handling device 70 it is preferred that this device is arranged such that it is offset from the finishing belt holding devices 56 of both subsets 56*a* and 56*b* when referring to the circumference of the workpiece 30. In a particularly preferred embodiment, the angular offset between the finishing belt handling device 70 and each of the subsets 56*a*, 56*b* is 90°, (FIG. 6).

As described above, each finishing belt holding device 56 includes a holding plate 58. Each finishing belt holding device 56 includes a supply 101 of finishing belt 102, in particular a supply roll 104 which is rotatable about a supply roll axis 106. The supply roll axis 106 is vertical and associated to the holding plate 58.

Each finishing belt holding device 56 also includes a driving unit 108 for driving (pulling) finishing belt 102 in a driving direction 109.

The finishing belt 102 is supplied by supply roll 104 and then guided to a pressing device 110 which includes a pressing head 112 which is movable with respect to a housing 114 along a horizontal moving axis 116 and which is also pivotable about a vertical axis in order to be able to follow a pin bearing which upon rotation of the workpiece 30 moves along an orbit around the workpiece axis 32.

In particular referring to FIG. 7, the finishing belt 102 of each finishing belt holding device 56 includes a holding section 118 for holding a portion 120 of a finishing belt 102, wherein an active area 122 of portion 120 is exposed to a circumferential workpiece surface 124 of the workpiece 30.

The portion 120 of finishing belt 102 extends in a vertical plane and, when referring to a running direction 126 of the finishing belt 102, in a horizontal direction. The running direction 126 of the finishing belt 102 is horizontal, corresponding to the vertical orientation of the supply roll axis 106.

During operation of the finishing device 10, the workpiece 30 is driven in a rotational direction 128 about workpiece axis 32, (FIG. 7). This rotational movement is caused by first drive 40 (FIG. 2). A linear oscillating movement 130 (FIG. 7) is imposed on the rotational movement 128. In particular, the oscillating movement 130 is a back and forth movement along workpiece axis 32 and caused by second drive 42 (FIG. 2).

During the machining of workpiece 30, the active area 122 of a portion 120 of a finishing belt 102 contacts a circumferential surface 124 of the workpiece 30. The circumferential surface 124 may for example be a pin bearing surface 132 (FIG. 7) or a main bearing surface 134.

It is preferred that a first subset 56*a* of finishing belt holding devices 56 is associated with a particular type of circumferential workpiece surfaces 124, for example with pin bearing surfaces 132. Accordingly, a second subset 56*b* of finishing belt holding devices 56 is associated with another type of circumferential workpiece surfaces 124, for example with main bearing surfaces 134.

The first subset 56*a* of finishing belt holding devices 56 may be associated with a first further drive (not shown) for oscillating the first subset 56*a* of finishing belt holding devices 56 in a vertical direction. Similarly, the second subset 56*b* of finishing belt holding devices 56 may be associated with a second further drive for oscillating the second subset 56*b* of finishing belt holding devices 56 in a vertical direction. Therefore, the handling devices 56 of a particular subset 56*a* and/or 56*b* may be driven in an oscillating manner and independently of second drive 42.

It is preferable that the first further drive and/or the second further drive provide for an oscillating movement of the handling devices 56 of subsets 56*a* and/or 56*b*, this movement having a lower frequency and a higher amplitude than the movement of the workpiece 30 caused by the second drive 42 which may take place at a higher frequency and a lower amplitude. However, it is also possible that the first further drive and/or the second further drive provide for an oscillating movement of the handling devices 56 of subsets 56*a* and/or 56*b*, this movement having a higher frequency and a lower amplitude than the movement of the workpiece 30 caused by the second drive 42 which may take place at a lower frequency and a higher amplitude.

When making use of an optional finishing belt handling device 70, exterior, abrasive sides of the finishing belt 74 of the finishing belt handling device 70, namely a lower side 136 and an upper side 138 of the working area 76, contact workpiece surfaces 140 which extend in planes perpendicular to the workpiece axis 32. The workpiece surfaces 140 may be thrust faces of a crankshaft. The lower side 136 and an upper side 138 are driven by drive 94 (FIGS. 5*a* and 5*b*) and move in an oscillating manner along the horizontal axis 95 as indicated by a double arrow in FIG. 7.

Since the active area 76 of the finishing belt handling device 70 is movable along a vertical axis 83 (FIGS. 5*a* and 5*b*) the active area 76 of the finishing belt handling device 70 can at least passively follow the oscillating movement 130 of the workpiece 30. When using a connector 100 (FIGS. 5*a* and 5*b*), the active area 76 is actively driven in a vertical oscillating manner and synchronously with the workpiece 30. In both cases, i.e. independent of a connector 100 being used or not, the active area 76 can machine workpiece surfaces 140 at the same time as the finishing of the circumferential workpiece surfaces 124 takes place by means of the finishing belts 102 of finishing belt holding devices 56.

Due to the vertical concept of the device 10, the footprint of the machine frame 12 and all parts of the device which are arranged on top of the machine frame 12 is small compared to conventional horizontal concepts known from prior art.

The invention claimed is:

1. A finishing device for finishing a workpiece such as a camshaft or a crankshaft having a first end and a second end, the finishing device comprising:

a finishing belt holding device including a finishing belt;

a first drive configured to rotationally drive the workpiece about a workpiece axis;

a second drive configured to oscillate the workpiece and the finishing belt relative to one another along the workpiece axis; and a workpiece holding device defining a workpiece holding axis which is vertical with respect to the direction of gravity, the workpiece holding device comprising a first workpiece holding element configured to attach to the first end of the workpiece and a second workpiece holding element configured to attach to the second end of the workpiece, wherein the finishing belt holding device has a holding section configured to hold a portion of the finishing belt, the portion having an active area configured to finish a circumferential workpiece surface of the workpiece, the portion extending in a vertical plane with respect to the direction of gravity, and, with respect to a running direction of the finishing belt, in a horizontal direction, wherein the finishing belt holding device includes a holding plate extending in a holding plate plane which is horizontal with respect to the direction of gravity, and wherein the holding plate is pivotable between a working position and a maintenance position in the horizontal direction about a pivot axis which is vertical with respect to the direction of gravity.

2. The finishing device according to claim 1, wherein the finishing belt holding device includes a supply of finishing belt which includes a supply roll which is rotatable about a supply roll axis which is vertical with respect to the direction of gravity.

3. The finishing device according to claim 1, wherein the finishing belt holding device includes a driving unit configured to drive the finishing belt in a driving direction which is horizontal with respect to the direction of gravity.

4. The finishing device according to claim 1, further comprising a guiding device which, in the working position of the holding plate, compensates for at least one of a vertical misalignment or a deflection of the holding plate.

5. The finishing device according to claim 1, including multiple finishing belt holding devices with a first subset of the finishing belt holding devices being offset from a second subset of the finishing belt holding devices with respect to the circumference of the workpiece.

6. The finishing device according to claim 5, wherein the offset between the first subset and the second subset is an angle of about 180°.

7. The finishing device according to claim 5, wherein the finishing belt holding devices of the first subset are offset from the finishing belt holding devices of the second subset with respect to the workpiece axis.

8. The finishing device according to claim 1, wherein at least one finishing belt handling device is configured to finish at least one workpiece surface extending in a workpiece plane which is perpendicular to the workpiece axis.

9. The finishing device according to claim 8, wherein the at least one finishing belt handling device is offset from the finishing belt holding device with respect to the circumference of the workpiece.

10. The finishing device according to claim 9, wherein the offset is an angle of about 90° or about 180°.

11. The finishing device according to claim 8, wherein the at least one finishing belt handling device is movable between a working position and a maintenance position along an axis which is horizontal with respect to the direction of gravity.

12. The finishing device according to claim 11, further comprising a drive configured to drive the at least one finishing belt handling device along the axis.

13. The finishing device according to claim 8, wherein at least a working area of the at least one finishing belt handling device is movable along an axis which is vertical with respect to the direction of gravity.

14. The finishing device according to claim 13, wherein the finishing belt handling device is supported by a weight supporting device compensating for the weight of the finishing belt handling device.

15. The finishing device according to claim 8, further comprising a mass compensation device configured to compensate for the mass inertia of the finishing belt handling device.

16. The finishing device according to claim 1, further comprising a mass compensation device configured to compensate for the mass inertia of at least one of the first drive, the second drive, the workpiece holding device, or the workpiece.

17. The finishing device according to claim 1, further comprising a machine housing including housing parts which are movable between a working position and a maintenance position, and a drive for moving the housing parts.

* * * * *